US005607082A

United States Patent [19]

Cracauer

[11] Patent Number: 5,607,082

[45] Date of Patent: Mar. 4, 1997

[54] REUSABLE COMPRESSION SPRAYER UTILIZING A DISPOSABLE COLLAPSIBLE BAG

[75] Inventor: Raymond Cracauer, Plymouth, Minn.

[73] Assignee: H. D. Hudson Manufacturing Company, Chicago, Ill.

[21] Appl. No.: 457,762

[22] Filed: Jun. 1, 1995

[51] Int. Cl.[6] ..... B65D 83/00

[52] U.S. Cl. ..... 222/95; 222/402

[58] Field of Search ..... 222/95, 105, 401, 222/402, 386.5; 239/323

[56] References Cited

U.S. PATENT DOCUMENTS

| | | | |
|---|---|---|---|
| 817,054 | 3/1906 | Gay | 222/95 X |
| 1,751,129 | 3/1930 | Cocks | 222/95 |
| 4,034,896 | 7/1977 | Wilson | 222/95 |
| 4,043,510 | 8/1977 | Morris | 239/323 |
| 4,121,736 | 10/1978 | McGaw, Jr. | 222/401 X |
| 5,398,852 | 3/1995 | Lacy | 239/323 X |

*Primary Examiner*—Gregory L. Huson
*Attorney, Agent, or Firm*—Kane, Dalsimer, Sullivan, Kurucz, Levy, Eisele and Richard, LLP

[57] ABSTRACT

A compression sprayer is provided with a bag in the tank for holding the product to be sprayed. The bag may be initially provided in folded, collapsed, sealed condition containing the product in concentrated form. The folded bag is then mounted interiorially of the tank and filled with liquid to provide the solution to be sprayed. The bag unfolds as it is filled and thereafter is coupled with the tank outlet. An internally mounted pump assembly pressurizes the interior of the tank to compress the bag which collapses as the contained liquid is sprayed.

5 Claims, 5 Drawing Sheets

REUSABLE COMPRESSION SPRAYER UTILIZING A DISPOSABLE COLLAPSIBLE BAG

BACKGROUND OF THE INVENTION

The present invention relates to compression sprayers for spraying under pressure sprayable solutions including pesticides, insecticides, industrial, agricultural, and garden chemicals and the like, and more particularly to a sprayer in which the solution is contained in a bag which may be removed from the sprayer tank when empty and discarded safely without the need to wash out the interior of the tank.

Compression sprayers operate under air pressure generated by intermittent activation of a pump and collected in the tank in a manner whereby spraying may be intermittently or continuously effected over a substantial period of time or until the pressure in the tank is sufficiently decreased or exhausted as to require the operator to again manipulate the pump to build up sufficient operating air pressure in the tank.

The tank is usually filled with the desired chemical in concentrated form and diluted by adding water to arrive at the desired solution for spraying. The concentrate and the solution may be hazardous, toxic or ecologically undesirable and heretofore when the tank was empty following spraying, the tank would be required to be cleaned for reuse with the inherent danger of the operator being exposed or perhaps coming in contact with the liquid. Moreover, rules and regulations may prohibit the discarding of the tank residue or the cleaning material and liquid. The cleaning residues become left over material which may very well contaminate the environment when the cleaning operation is taking place.

SUMMARY OF THE INVENTION

A principal object of the present invention is not to contaminate the environment by washing out and cleaning a compression sprayer after each use. In this regard the present invention eliminates this contamination of the environment by eliminating the need for sprayer tank washing and water contamination at the point of use.

A further object is to provide a compression sprayer with a collapsible bag, pouch or lining that may be discarded after completion of a spraying operation, but more importantly, may be pre-loaded in concentrated form in the bag and sold in this fashion commercially as a sealed receptacle to avoid having an operator handle an otherwise hazardous, toxic or dangerous chemical.

DETAILED DESCRIPTION OF THE DRAWINGS

Figure 1:
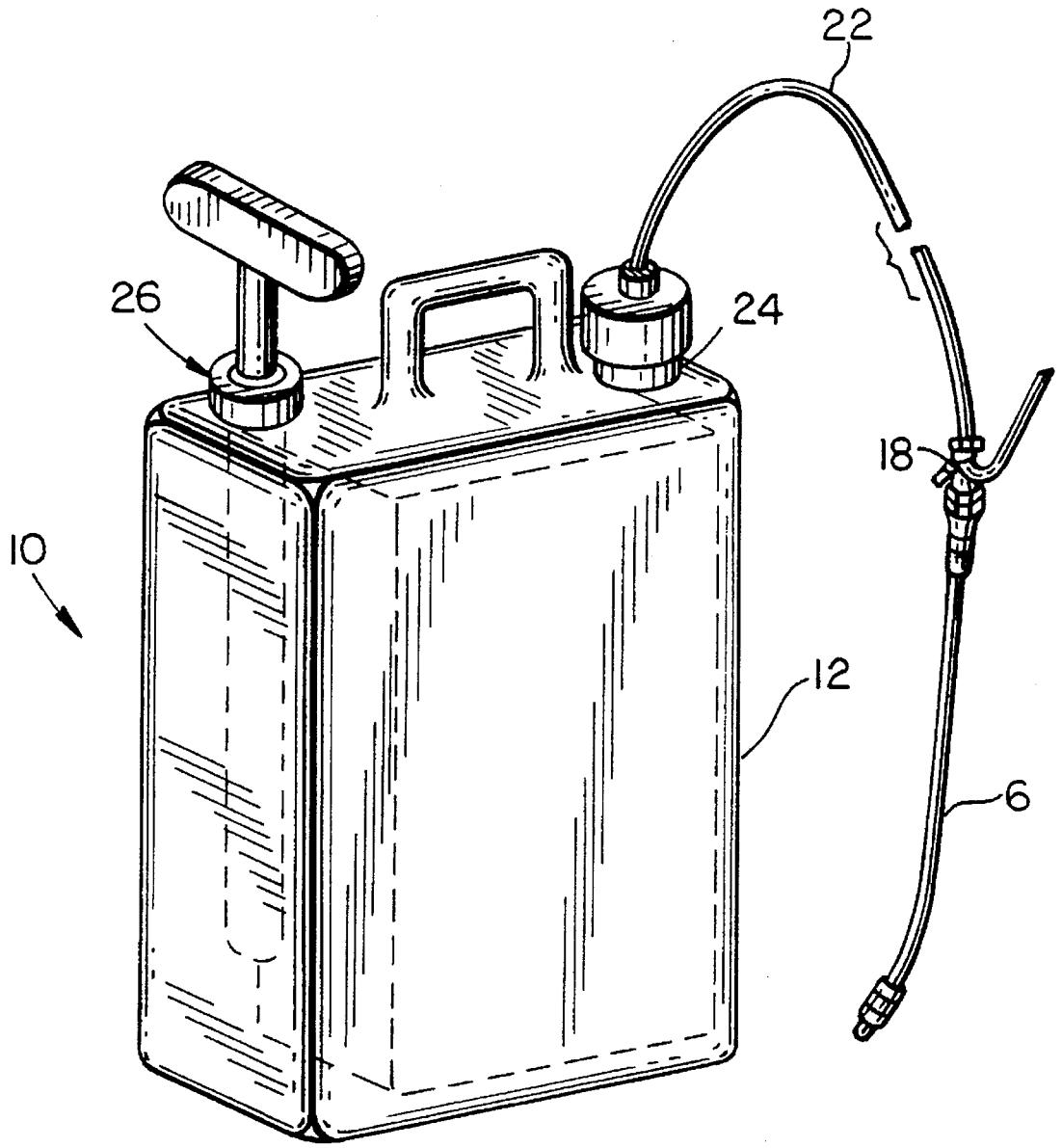
FIG. 1 is a perspective view of an assembled compressor sprayer embodying the teachings of the present invention.

In the drawings, the compression sprayer 10 of the present invention comprises a tank 12 for containing a liquid or spray solution to be dispensed in a desired or selected spray pattern under pressure through an adjustable discharge nozzle 14 and the distal end of an extension rod 16. The discharge is controlled by a manually operated valve 18 at the proximal end of the rod and interposed between the rod and tubing 22 extending from the outlet 24 of the tube 10.

The interior of the tank is pressurized by the manually actuated reciprocal piston pump assembly 26. Pump assembly 26 may be anyone of the pump assemblies used in commercially available sprayers or may be of the type disclosed in commonly owned U.S. Patent application Ser. No. 08/218,767 filed Mar. 28, 1994. The pump assembly 26 may be coupled to the tank 12 as shown or as disclosed in the above referenced patent application.

Figure 2:
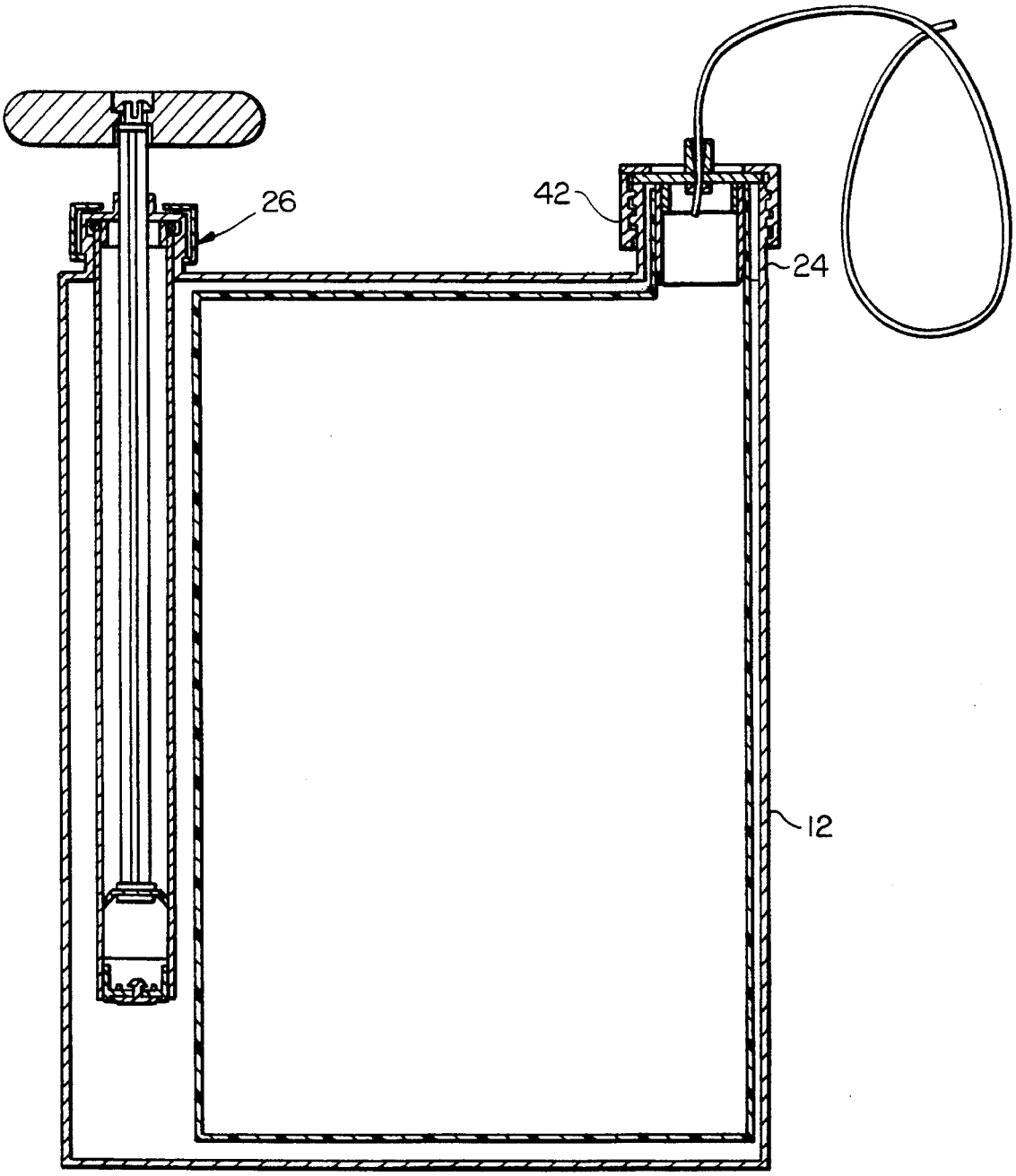
FIG. 2 is an enlarged longitudinal sectional view of the sprayer tank incorporating a disposable bag for the spray solution.
Figure 3:
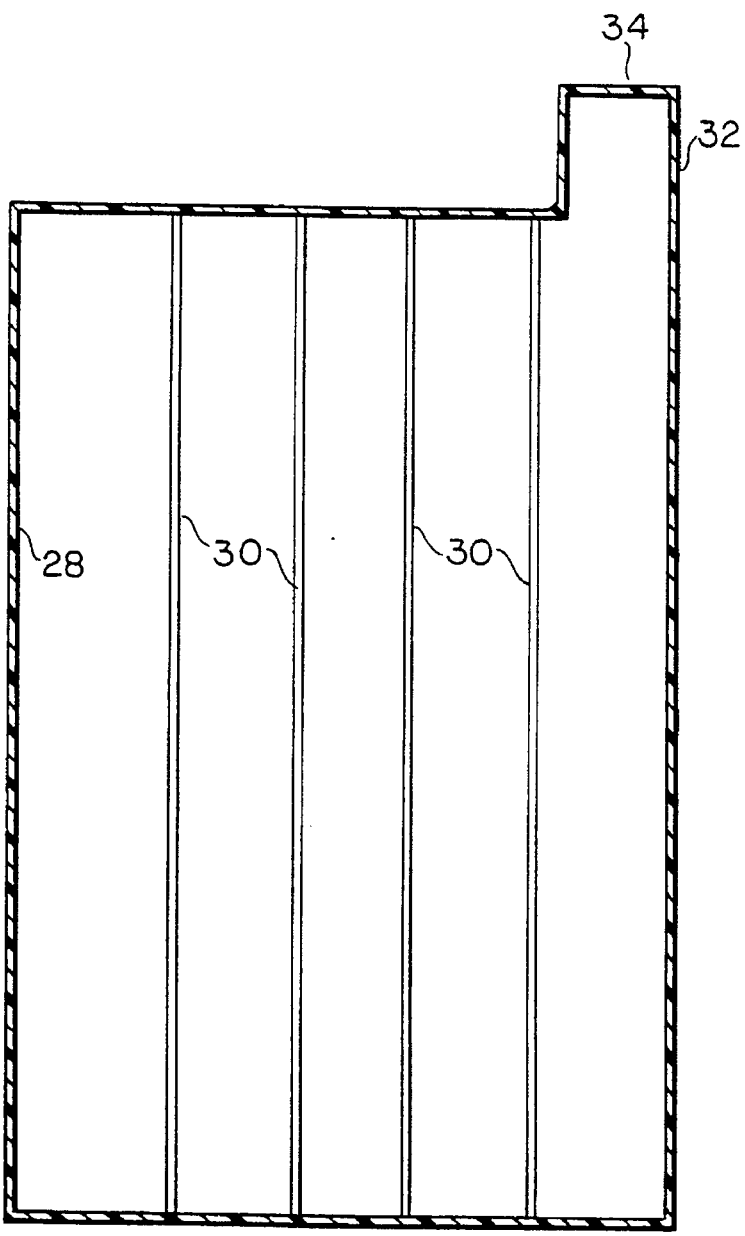
FIG. 3 is a sectional view of a sealed unfolded pleated disposable bag usable with the present invention.
Figure 4:
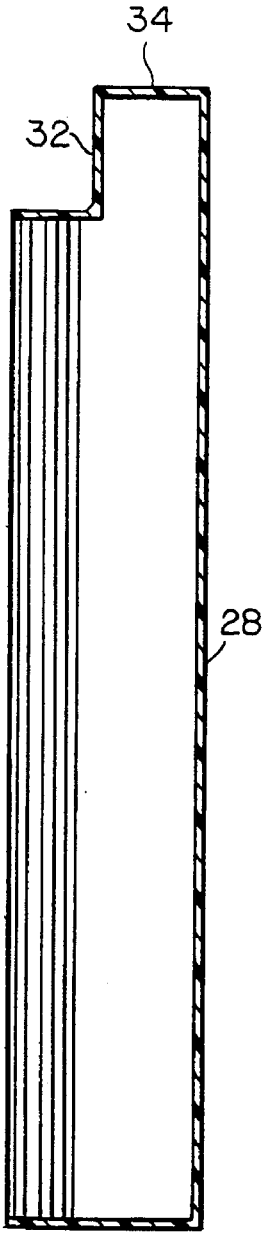
FIG. 4 is a similar sectional view of the sealed bag of FIG. 3 in a collapsed folded position.

The solution to be sprayed will be contained in bag 28 mounted in the interior of tank 12. Bag 28 is designed so that when full it will not interfere with the operation of the pump assembly 26 as shown in FIG. 2. The bag 28 may be initially provided in a folded collapsed condition as shown in FIG. 4 which may be facilitated by pleats 30. The outlet 32 of the bag 28 may be sealed with a seal 34 as shown in FIGS. 3 and 4 particularly if the bag is filled with concentrated product such as powder or liquid concentrate or has the desired or selected chemical spray dried on the interior of the bag prior to forming and/or sealing. A fill spout 36 is inserted into the outlet 32 after the seal 34 is removed prior to installing bag 28 in the tank 12 or could be preassembled to the bag and heat sealed to the outlet 32.

Figure 5:
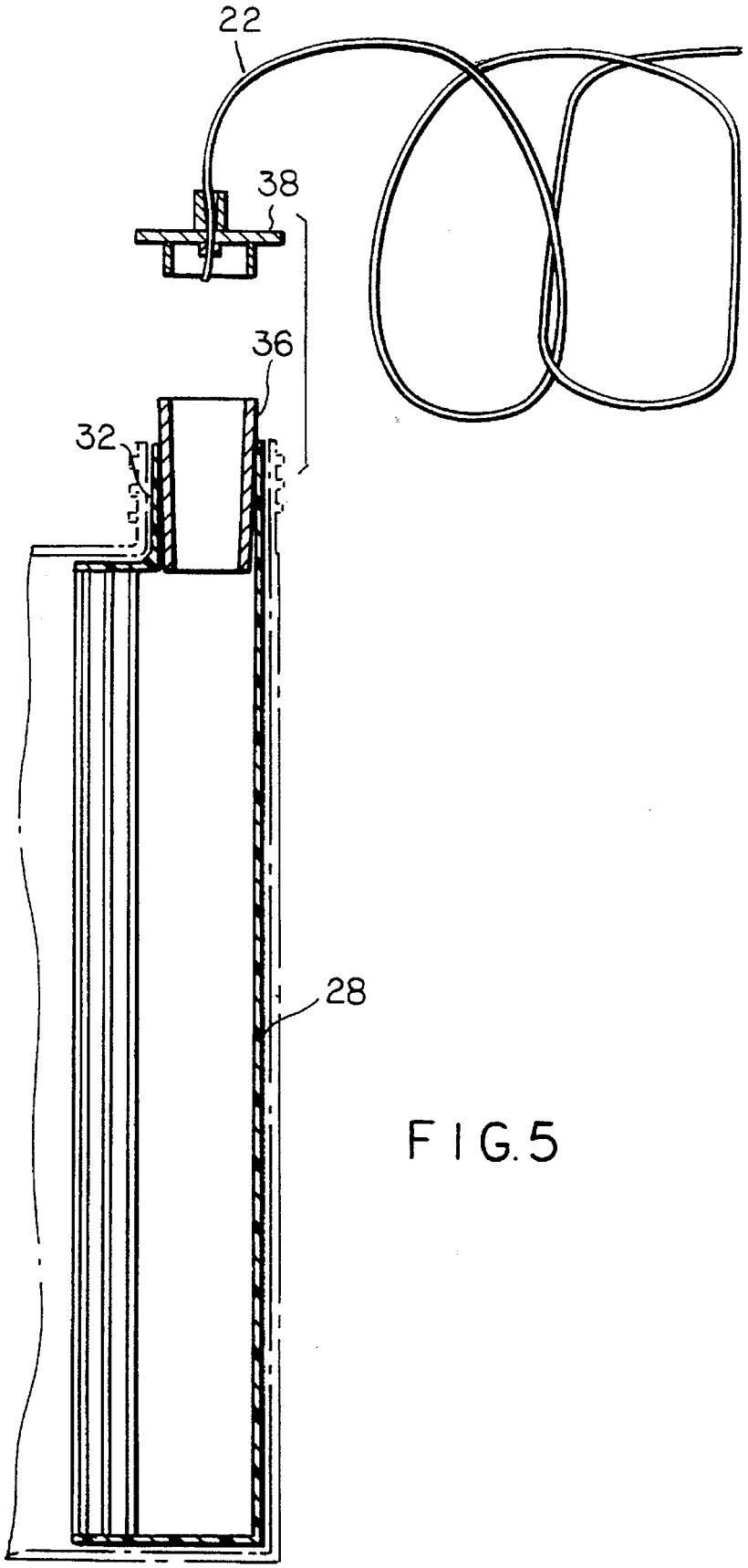
FIG. 5 is an exploded sectional view of the tube and outlet coupling and the bag of FIG. 4 shown in an unsealed condition ready to be inserted into the tank interior and filled with liquid.
Figure 6:
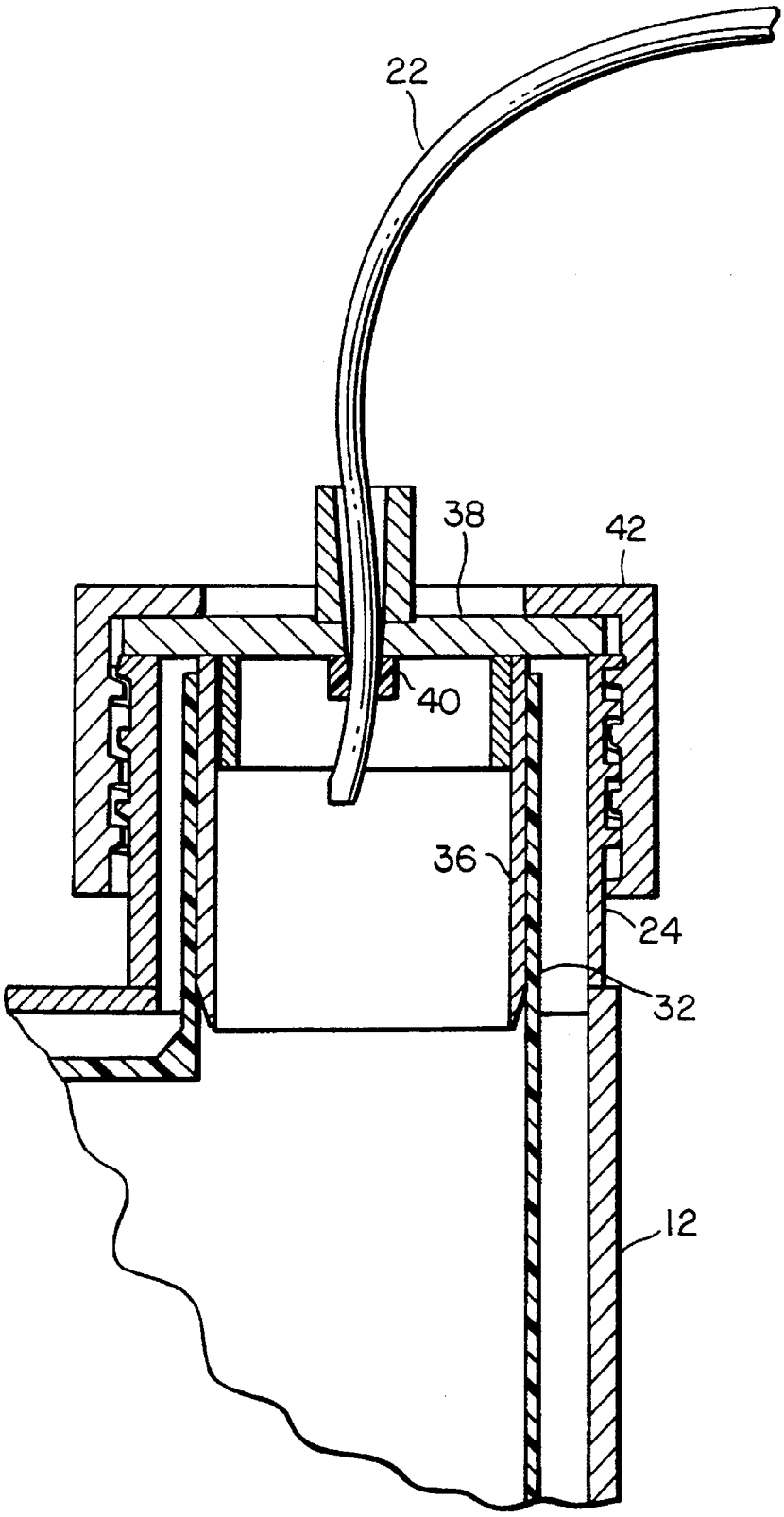
FIG. 6 is an enlarged sectional view of the outlet of the tank showing the coupling of the bag outlet and outer tube coupling.

The folded bag 28 of FIG. 5 is placed in the tank 12 through the tank outlet 24 and is filled with liquid. The bag 28 will unfold as it fills with liquid. When the bag 28 is filled to the desired extent, the outlet 32 and specifically, the fill spout 36 is coupled to tubing and capped by cap 38 and retainer 40 which is adapted to provide a seal with the spout 36 as well as the mouth of the tank outlet 24. The closure ring 42 is adapted to be threadedly connected with the outlet 24 as shown to maintain this sealed condition.

After capping, the interior of the tank may be pressurized with the pump assembly 26. The bag 28 will collapse as the liquid therein is sprayed and metered out. In this fashion, the present invention allows an essentially total dispensed volume regardless of orientation. When empty, the bag 28 can be withdrawn from the interior of the tank 2 and then be conveniently discarded.

Accordingly, the present invention provides an ecologically suited system for handling, spraying and disposing of hazardous materials and residues. The chemicals to be sprayed may be advantageously supplied commercially as a concentrated product in dry or liquid form in the collapsed and sealed bag 28. No dip tub is needed. The expended bag following spraying may be removed when empty and discarded as prescribed. The sprayer 10 can be reused without having to wash out the interior of the tank 12.

Thus, the several aforenoted advantages are most effectively attained. Although a single somewhat preferred embodiment of the invention has been disclosed and described in detail herein, it should be understood that the invention is in no sense limited thereby and its scope is to be determined by that of the appended claims.

I claim:

1. A compression sprayer comprising a tank having an exterior, an interior, a top and an outlet at the top and a manually activated piston pump assembly mounted in the interior of the tank for pressurizing the tank interior, the pump assembly coupled to the top and having a manually reciprocal piston handle extending exterior of the top, discharge tubing exterior of the tank and coupled with the outlet and having a discharge nozzle coupled therewith and a valve for controlling the discharge from the nozzle, and a bag having an outlet and coupled with the tank outlet and adapted to contain a liquid solution to be sprayed and adapted to collapse under the pressure generated by the pump assembly within the tank interior as the liquid solution is discharged from the bag into the tubing and out through the nozzle in a predetermined spray pattern.

2. The invention in accordance with claim 1 wherein the bag includes pleats for permitting this bag to be folded to a collapsed position that permits insertion of this collapsed bag into-the tank through the tank outlet and an unfolded position as it is filled with the liquid solution to be sprayed.

3. The invention in accordance with claim 1 wherein the bag outlet is initially sealed and contains a selected concentrate and is unsealed prior to filling with liquid to provide the liquid solution from the concentrate for spraying.

4. The invention in accordance with claim 1 wherein a fill spout is sealed to the bag outlet to facilitate the filling of the bag with liquid and the coupling with the tank outlet.

5. The invention in accordance with claim 1 wherein the bag includes pleats for permitting this bag to be folded to a collapsed position that permits insertion of this collapsed bag into the tank through the tank outlet and an unfolded position as it is filled with the liquid solution to be sprayed, the bag outlet is initially sealed and contains a selected concentrate and is unsealed prior to filling with liquid to provide the liquid solution from the concentrate for spraying, a fill spout is sealed to the bag outlet to facilitate the filling of the bag with liquid and the coupling with the tank outlet.

* * * * *